United States Patent [19]

Stahlecker

[11] Patent Number: 4,920,736

[45] Date of Patent: May 1, 1990

[54] ARRANGEMENT FOR INTERRUPTING THE OPERATION OF AN INDIVIDUAL DRAFTING FRAME AT A SPINNING MACHINE

[75] Inventor: Fritz Stahlecker, Bad Uberkingen, Fed. Rep. of Germany

[73] Assignee: Hans Stahlecker, Fed. Rep. of Germany

[21] Appl. No.: 242,314

[22] Filed: Sep. 9, 1988

[30] Foreign Application Priority Data

Sep. 23, 1987 [DE] Fed. Rep. of Germany ..... 3731886

[51] Int. Cl.[5] ..... D01H 13/16; D01H 13/18; D01G 31/00

[52] U.S. Cl. ..... 57/84; 19/0.25; 19/236; 19/24.4; 57/80; 57/83; 57/87

[58] Field of Search ..... 57/80, 83–87; 19/0.25, 236, 239, 244

[56] References Cited

U.S. PATENT DOCUMENTS

| | | | |
|---|---|---|---|
| 4,112,658 | 9/1978 | Morihashi | 57/328 |
| 4,480,354 | 11/1984 | Glock et al. | 19/0.25 |
| 4,484,376 | 11/1984 | Glock et al. | 19/0.25 |
| 4,510,645 | 4/1985 | Glock | 19/0.25 |
| 4,630,434 | 12/1986 | Hartmannsgruber et al. | 57/86 X |
| 4,644,609 | 2/1987 | Lattner | 57/87 X |

*Primary Examiner*—John Petrakes

*Attorney, Agent, or Firm*—Evenson, Wands, Edwards, Lenahan & McKeown

[57] ABSTRACT

In an arrangement for interrupting the operation of an individual drafting frame at a spinning machine, devices are provided for reducing the contact of a sliver with the bottom rollers and particularly for lifting the sliver off the bottom rollers which are operative when the pressure rollers are lifted off the bottom rollers.

19 Claims, 22 Drawing Sheets

ARRANGEMENT FOR INTERRUPTING THE OPERATION OF AN INDIVIDUAL DRAFTING FRAME AT A SPINNING MACHINE

BACKGROUND AND SUMMARY OF THE INVENTION

The invention relates to an arrangement for interrupting the operation of an individual drafting frame at a spinning machine which is equipped with a plurality of identical drafting frames containing several driven bottom rollers which extend over a plurality of spinning positions or units and containing pressure rollers assigned to the individual spinning units and held by means of load carriers. The spinning units are equipped with devices for lifting the pertaining load carrier and the pressure rollers off the bottom rollers, and with devices for the clamping-in of the respective entering sliver which are controlled by monitoring devices responding to a disturbance.

Multiple arrangements are known for interrupting the operation of an individual drafting frame which are used particularly in the case of a yarn breakage. These arrangements have the advantage that, after a yarn breakage, no further fiber material will enter the drafting frame which is then sucked off as waste or may lead to the danger of a lap formation in the area of the delivery rollers. The known arrangements require a manual operation by means of which, when the respective spinning unit is restarted, the sliver must be introduced into the drafting frame. Even if the sliver still remains in the area of the feeding rollers when the operation of the drafting frame is interrupted, it is necessary, as a rule, to introduce the sliver manually into the area of the main drafting field in which double apron units and condensers or the like are arranged. In practice, it cannot be expected that, in the case of a restarting, the sliver will find the correct path by itself.

In the case of a wind-around yarn spinning machine with a high-draft drafting frame (Süssen-Parafil 2000), it is known, in the case of a yarn breakage, to clamp in the sliver in front of the drafting frame and, at the same time, move the load carrier with the pressure rollers away from the bottom rollers. In this arrangement, the sliver remains inside the drafting frame and usually extends to the pair of output rollers or the pair of delivery rollers. Also in the case of this arrangement, a manual activity is, however, required during the restarting process because, particularly in the case of extended stoppages, there is no guarantee that the sliver is still present in the area of the main drafting field and particularly in the area of the pair of delivery rollers or the pair of output rollers. This arrangement is therefore not yet completely suitable for automation.

An object of the invention is to develop an arrangement of the initially mentioned type such that the certainty of the restarting of a drafting frame is improved in such a manner that, without any manual operations, it is largely ensured that the sliver will securely and correctly enter and run between all pairs of rollers of the drafting frame.

This object is achieved by providing devices for reducing the contact of a sliver at the bottom rollers, these devices being operative when the pressure rollers are lifted off the bottom rollers.

The invention is based on the recognition that, in the case of the known arrangement, despite the lifting of the pressure rollers off the bottom rollers, the sliver could still be damaged by the fact that individual tufts or parts of the sliver, because of the contact with the driven and continuously running bottom rollers, could be torn out unintentionally so that the sliver is damaged or even destroyed completely. This danger is avoided by using preferred embodiments of the invention in that the contact between the sliver and the bottom rollers is reduced or completely eliminated. This eliminating of the contact between the sliver and the bottom rollers in connection with the clamping-in of the sliver in the feeding area has the result that, also after an extended stoppage, an undamaged sliver is present in the drafting frame so that, by the pressing-back of the load carrier into its operative position, the operation of the drafting frame can be resumed in a simple manner. The elimination or reduction of the contact between the sliver and the bottom rollers may be achieved by means of relatively simple and inexpensive devices according to especially preferred embodiments of the invention. As a result, advantages are achieved at low cost which, at best, are known in the case of drafting frames equipped with individual drives, i.e., with drives which drive one or only two spinning units. In these drafting frames, the bottom rollers can correspondingly be stopped individually. However, these drafting frames require such high expenditures that they have not found acceptance in practice.

Other objects, advantages and novel features of the present invention will become apparent from the following detailed description of the invention when considered in conjunction with the accompanying drawings.

DETAILED DESCRIPTION OF THE DRAWINGS

In the following description, components which have the same function and are largely constructed similarly are provided with the same reference number without repeating their description for every illustrated embodiment. In this case, when the components are in an inoperative position, a prime mark "'" is added.

Figure 1:
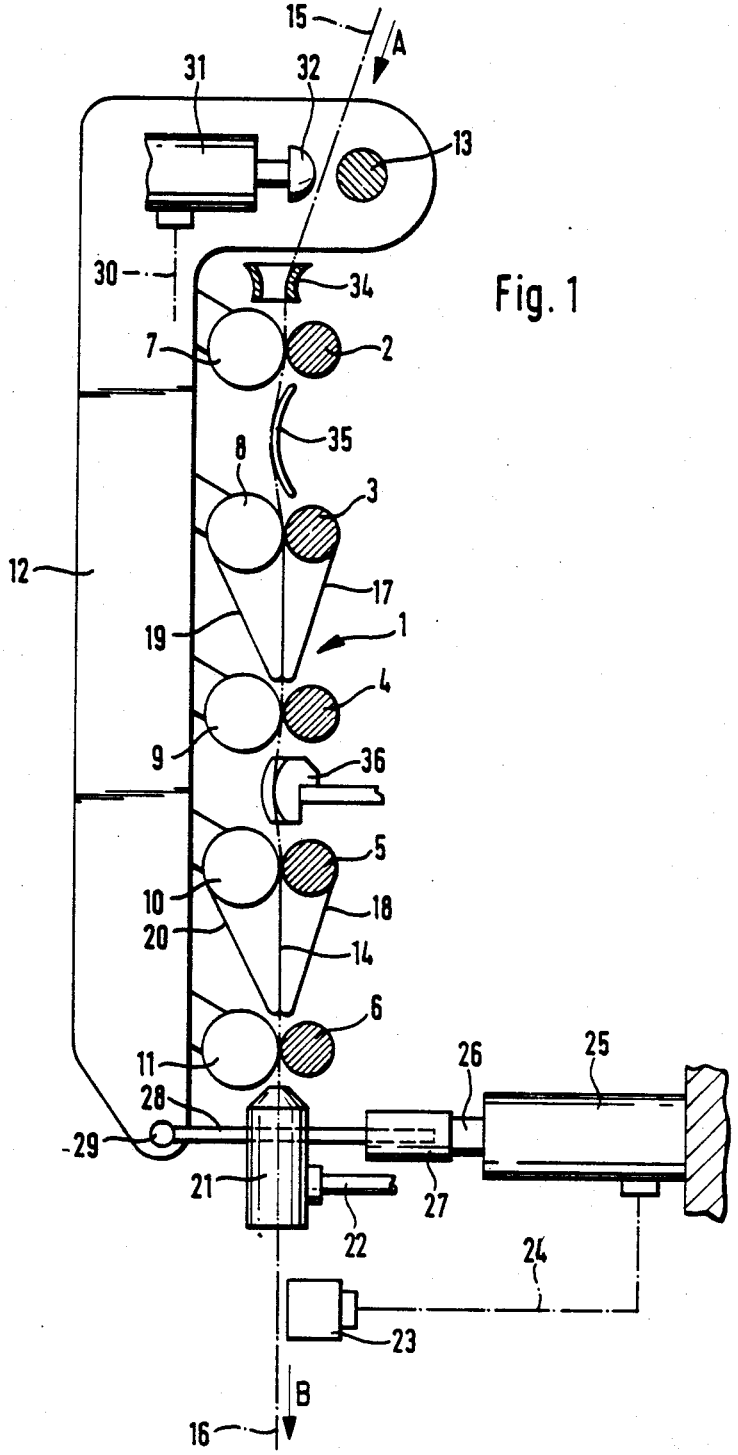
FIG. 1 is a schematic view of a drafting frame arrangement constructed in accordance with a preferred embodiment of the invention, which is shown in its sliver drafting operative position.
Figure 2:
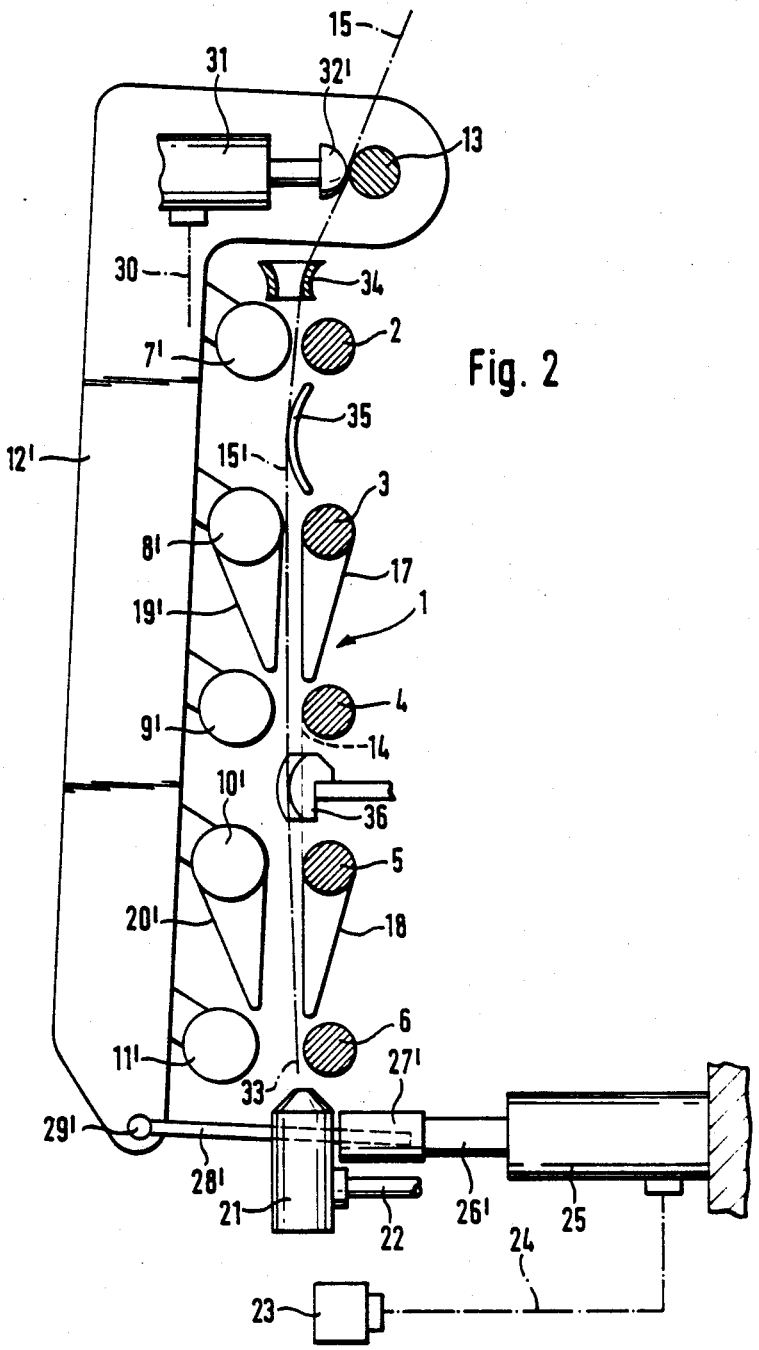
FIG. 2 is a view of the arrangement of FIG. 1 shown after a yarn breakage in the inoperative position.

The high-draft drafting frame 1 shown in FIGS. 1 and 2, which is a so-called five-cylinder drafting frame, contains five driven bottom rollers 2, 3, 4, 5, 6 which extend through the whole spinning machine and are driven in the headstock which is not shown. These bottom rollers 2 to 6 are thus a component part of all drafting frames of one side of the machine. At each spinning unit, pressure rollers 7, 8, 9, 10, 11 are assigned to the bottom rollers 2, 3, 4, 5, 6. In a known manner, these pressure rollers 7, 8, 9, 10, 11 are elastically held in a load carrier 12 and, by means of spring power, are pressed against the pertaining bottom rollers 2, 3, 4, 5, 6. The load carriers 12 receive the pressure rollers 7. 8, 9, 10, 11 conventionally in pairs, i.e., as so-called pressure roller twins, as shown in the following also by means of FIGS. 11 to 15. However, it is also known to equip load carriers 12 in each case only with individual pressure rollers 7, 8, 9, 10, 11.

The load carriers 12 are pivoted on a carrier rod 13 which is arranged in parallel to the bottom rollers 2, 3, 4, 5, 6 on the feeding side of a sliver 15 and which is located slightly offset with respect to a plane 14 of the drafting frame, i.e., a plane in which essentially the bottom rollers 2, 3, 4, 5, 6 are in contact with the pertaining pressure rollers 7, 8, 9, 10, 11.

A pressure rod 28 is linked to the free end of the load carrier 12, via a joint 29, and is connected with a piston 26 of a piston cylinder unit 25, via a fastening member 27. The piston cylinder unit 25 can be actuated electrically via a yarn monitor 23 which is connected to the piston cylinder unit 25, via a line 24. The piston cylinder 25 unit is, pneumatically actuated such that it pulls the load carrier 12 into the operative position (FIG. 1) in which it is then locked in the piston cylinder unit 25 against the effect of a spring. This locking can then be released via the yarn monitor 23, so that a spring transfers the load carrier 12 into the inoperative position (FIG. 2). The yarn monitor 23 is connected behind the drafting frame 1 and monitors the yarn 16 which leaves the drafting frame 1 and is strengthened by means of an air nozzle 21 supplied via a vacuum Pipe 22 and is withdrawn in the direction of the Arrow (B). A similar yarn monitor, which also affects the piston cylinder unit 25, may also be assigned to the feeding side and respond to the sliver 15 moving in in the direction of the Arrow (A). The yarn monitor 23 (and possibly the yarn monitor assigned to the entering sliver 15) also actuates a clamping member 32 which can clamp in the entering sliver 15 at the carrier rod 13 (FIG. 2) so that a further feeding of the sliver 15 is prevented. A control element 31 is assigned to the clamping member 32 and is controlled by the yarn monitor 23 or monitors. A solenoid may, for example, be provided.

The high-draft drafting frame 1 contains two double apron units which each consist of bottom aprons 17, 18 and top aprons 19, 20 with the corresponding guides.

As mentioned above, in the case of the shown embodiment, an air nozzle 21 is connected behind the high-draft drafting frame 1. However, instead of an air nozzle 21 of this type, other elements, particularly twist-providing or false-twist-providing elements may also be provided, such as hollow spindles for wind-around machines or the like.

To the extent that the high-draft drafting frame 1 was described corresponding to FIGS. 1 and 2, it also essentially corresponds to the developments of the following embodiments so that in connection with these embodiments, the previously mentioned elements do not have to be described again.

In order to achieve, in the case of the embodiment according to FIGS. 1 and 2, that the sliver 15 is lifted off the bottom rollers 2, 3, ,4, 5, 6, during a disturbance and the resulting lifting-off of the load carrier 12, a simple construction is provided which will suffice for many applications, particularly during the processing of long-staple fiber material. In front of the pair of feeding rollers 2, 7, a feeding funnel 34 is provided which is arranged so that it is slightly offset with respect to the plane 14 of the drafting frame 1 in the direction toward the load carrier 12. Between the bottom rollers 2, 3, a curved guiding table 35 is arranged stationarily which is also arranged to be slightly offset with respect to the plane 14 in the direction of the load carrier 12. Between the bottom rollers, 4, 5, another guiding element is arranged, specifically a so-called condenser 36 which, in moving direction (A) of the sliver 15, has an approximately V-shaped groove with a convexly curved groove base, the cross-section of which tapers in moving direction (A). This condenser 36 also is arranged stationarily slightly in the direction toward the load carrier 12, with respect to the plane 14. A deflection of this type of the sliver 15 within the drafting frame 1 is permissible, particularly in the case of long-staple fiber material, without any disturbance of the drafting.

In the case of a breakage of the yarn 16 (or also in the case of a breaking or absence of the sliver (15)), the high-draft drafting frame 1 is opened by the lifting-off of the load carrier 12 with the pressure rollers 7, 8, 9, 10, 11. In this case, at the same time, the sliver 15 is clamped in against the carrier rod 13 in the feeding area by means of the clamping member 32. As a result of the arrangement of the stationary guiding elements 34, 35, 36, the sliver 15 takes up the position shown in FIG. 2 in which it is lifted off the bottom rollers 2, 3, 4, 5, 6.

In the case of the embodiment according to FIGS. 1 and 2, it is advisable, if suction devices are present, to switch off these suction devices by the opening of the high-draft drafting frame 1. In addition, it may be provided that the function of the air nozzle 21 is maintained which exercises an intake function in the direction toward the high-draft drafting frame 1. In certain cases, it may be advisable to maintain this suction effect only to a reduced extent.

As a result, it is achieved that the end of the sliver 15, in the area of the pair 6, 11' of rollers, is held in a drawn manner and is also laterally centered. In addition, it may be provided, in the case of an interruption of this type of the operation of the high-draft drafting frame 1, that the air nozzle 21 is automatically moved slightly in the direction toward the load carrier 12', by means of devices that are not shown, so that the feed opening, which serves as the intake opening, is also farther removed from the bottom cylinder 6.

Figure 3:
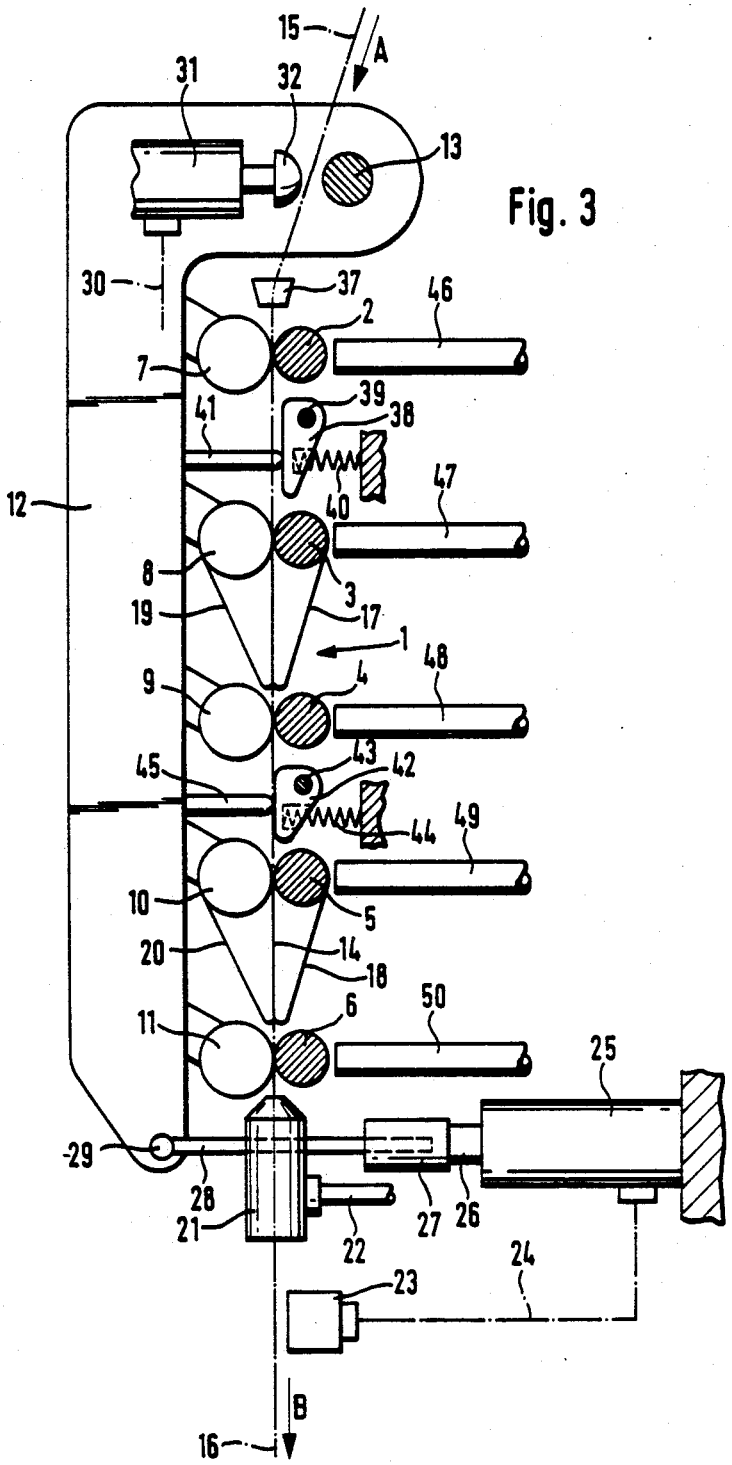
FIG. 3 is a schematic view of a drafting frame arrangement constructed according to another preferred embodiment of the invention and having elastic devices for lifting the sliver off the bottom rollers, shown in the operative position.
Figure 4:
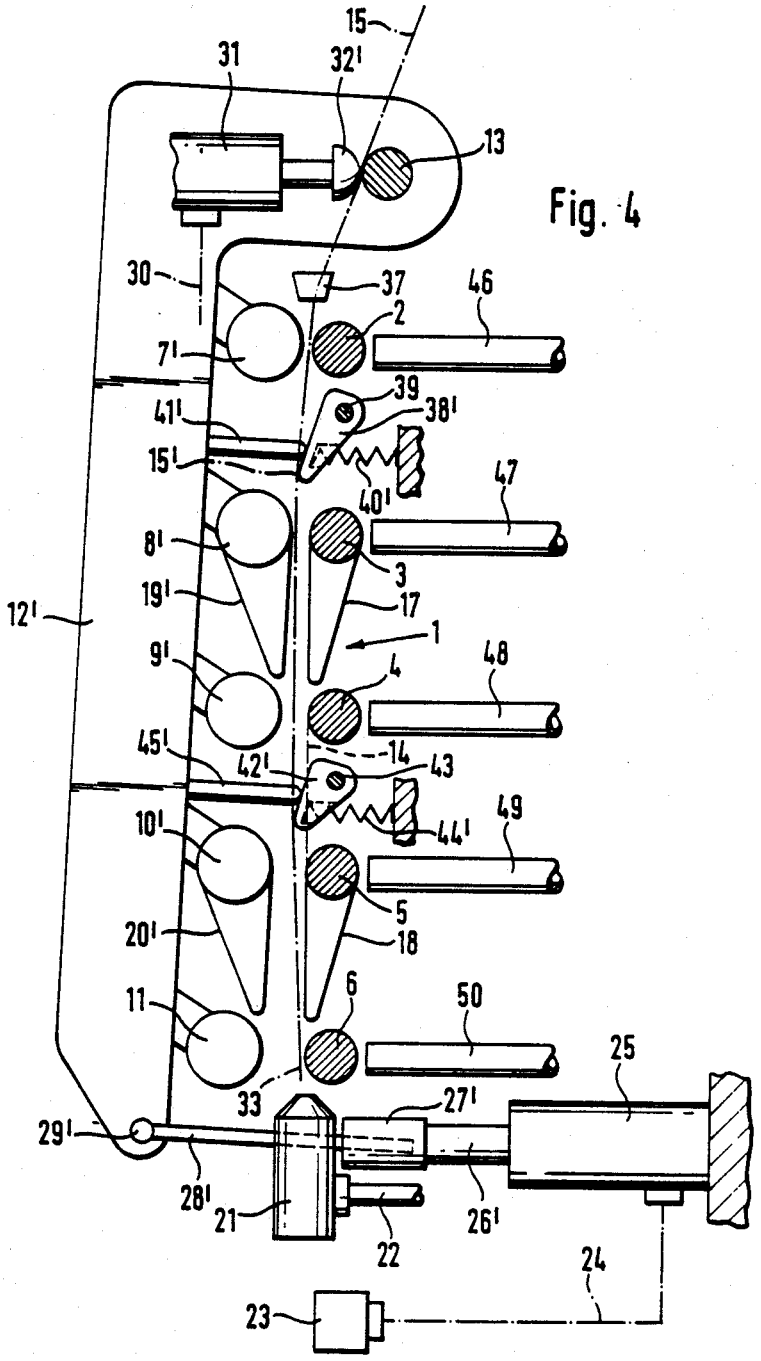
FIG. 4 is a view of the arrangement of FIG. 3, shown in the inoperative position.

In the embodiment according to FIG. 3 and 4, a stationary feeding funnel 37 is provided as an extension of the plane 14. Between the bottom rollers 2, 3, a guiding table 38 is arranged which can be swivelled around a shaft 39 extending in parallel with respect to the bottom rollers 2, 3 and which is loaded by means of a spring 40. This guiding table 38 is held, by means of a stop 41 of the load carrier 12 in the operative position shown in FIG. 3, in which it is located slightly outside the plane 14 of the drafting frame 1 and therefore does not come in contact with the sliver 15. Between the bottom rollers 4, 5, another guiding table 42 is arranged, the guiding surface of which is located in the plane 14, in the operative position (FIG. 3). This feeding table 42 can be swivelled around a shaft 43 extending in parallel to the bottom rollers 4,5 and is also loaded by means of a pressure spring 44. By means of the pressure spring 44, it is pressed against a stop 45 of the load carrier 12. The stops 41 and 45 are applied to the feeding tables 38, 42 outside the moving path of the sliver 15.

Intake pipes 46, 47, 48, 49, 50 are assigned to the bottom rollers 2, 3, 4, 5, 6 and expediently are constructed such that they can be controlled, i.e., that they can be switched off or moved away from the bottom rollers 2, 3, 4, 5, 6 for accommodating cleaning operation.

In the case of a breakage of the yarn 16 (or of the entering sliver 15), also in this embodiment, the load carrier 12 is lifted off (FIG. 4). The guiding tables 38, 42 will then move into the positions 38', 42' shown in FIG. 4 in which they lift the sliver 15 off the bottom rollers 2, 3, 4, 5, 6. Also in this case, it may be provided that the air nozzle 21, which acts as an injector and exercises an intake force, remains switched on so that the end 33 of the sliver 15 remains aligned. If necessary, also in this case, the air nozzle 21, in addition, can be slightly moved away from the area of the bottom roller 6.

In order to prevent that, as a result of possible air currents, the sliver 15, which hangs in the drafting frame 1 in a largely loose manner, is brought into a position from which it can no longer automatically approach correctly, air guiding surfaces, which are not shown, may be arranged in the drafting frame 1 and deflect harmful air currents or may possibly help generate a defined air flow which draws and centers the sliver 15. This applies particularly when the drafting frame 1 is to be cleaned pneumatically by means of a travelling aggregate. It is also contemplated to provide a movable servicing apparatus that has an arm equipped with a suction nozzle which grips the end 33 of the sliver 15 and draws it in the direction of the element which follows, particularly the air nozzle 21. It is expedient in this case for the suction nozzle to be covered by a screen so that the end 33 of the sliver 15 cannot be sucked in. A drawing movement of this type may be carried out shortly before the closing of the drafting frame 1.

As a modifiCation of the embodiment according to FIG. 3 and 4, the stops 41, 45 are not provided. This is possible if the guiding tables 38, 42 are arranged in an area in which the sliver 15 is still relatively thick and thus relatively firm. In this case, it may be provided, in coordination with the used springs 40, 44, that the sliver 15 itself holds the guiding tables 38, 42 in the operative position shown in FIG. 3, out of which they move when the sliver 15 is relaxed by means of the opening of the drafting frame 1. In this case, stationary stops are expediently provided which limit the swivelling movement of the guiding tables 38, 42 in the direction toward the load carrier.

Figure 5:
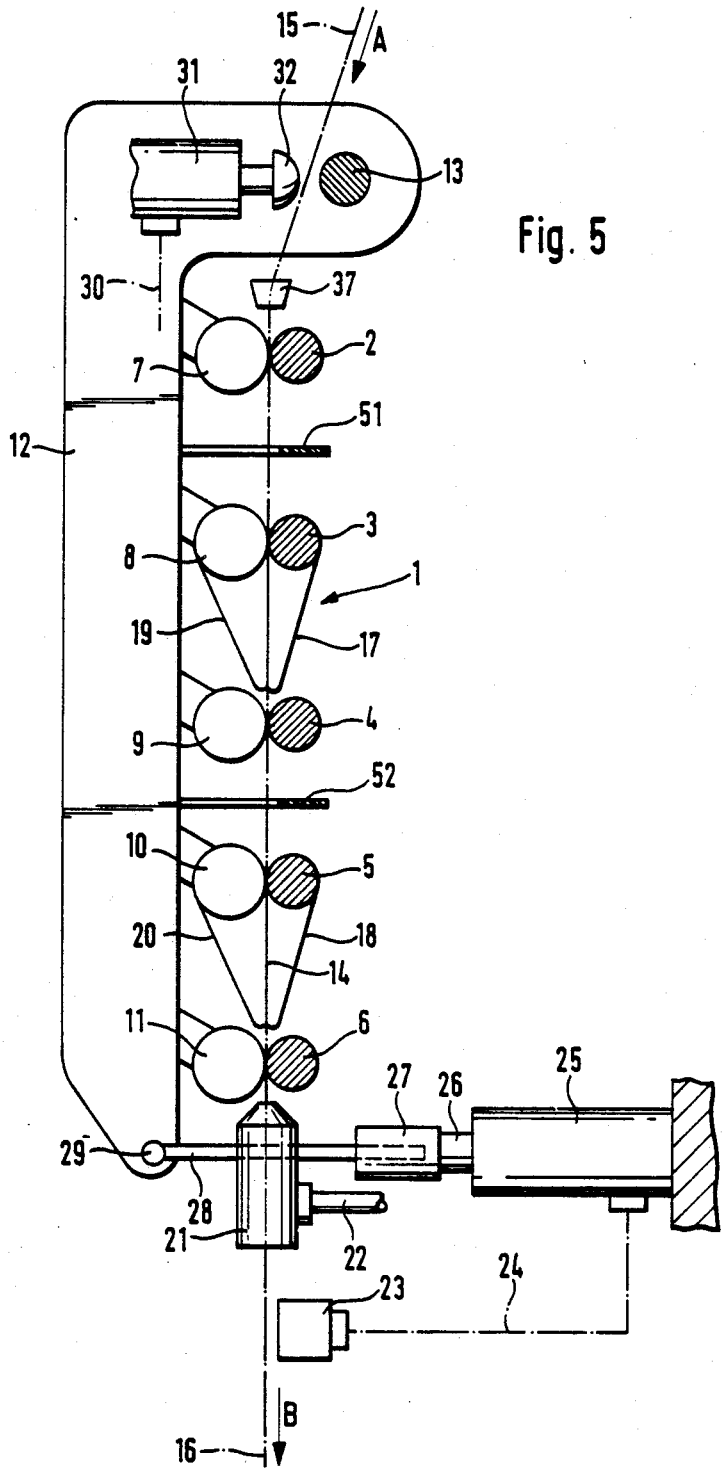
FIGS. 5 and 6 are schematic views of another preferred embodiment of the invention with devices mounted at a load carrier for lifting the sliver off the bottom rollers, shown respectively in the operative and in the inoperative positions.
Figure 6:
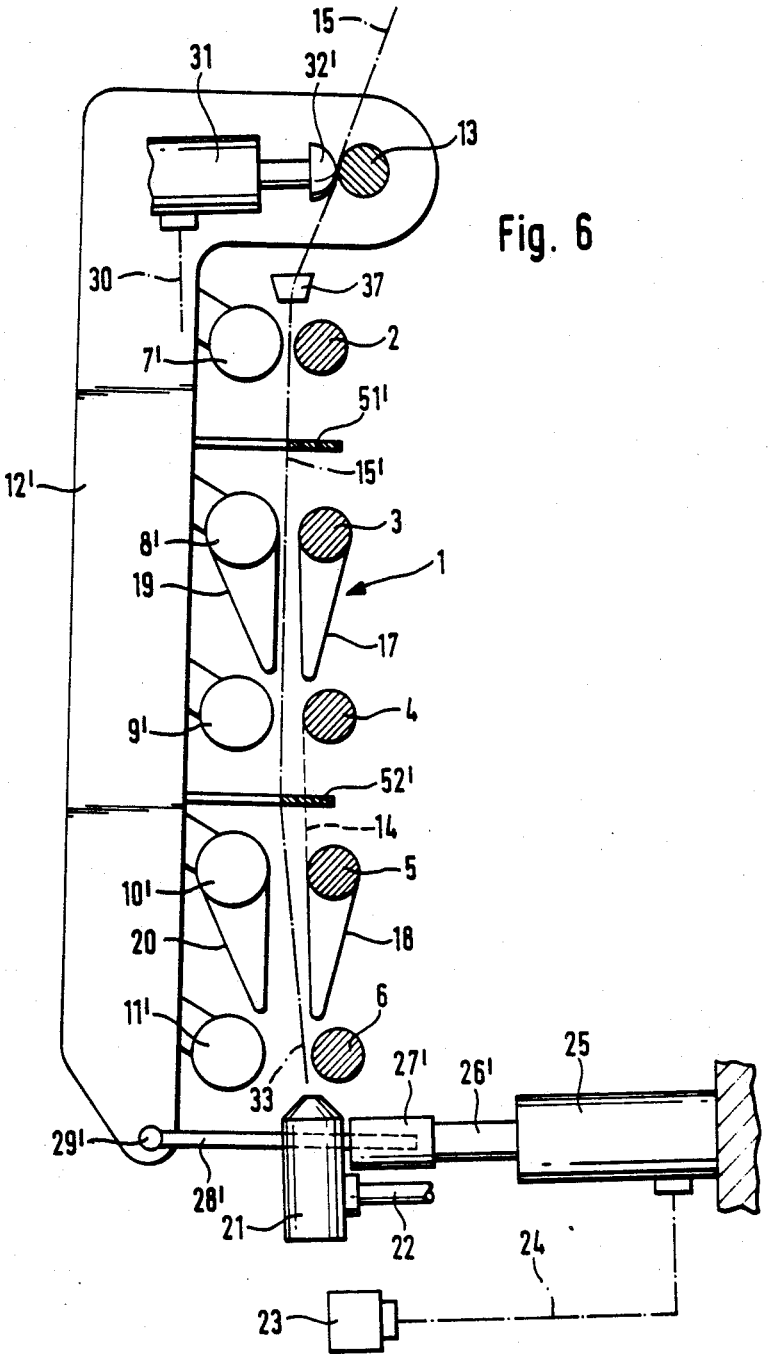

The embodiment according to FIGS. 5 and 6 can also be implemented in an uncomplicated and low-cost manner. In this embodiment, brackets 51, 52 are arranged in the area between the bottom rollers 2, 3 and the bottom rollers 4, 5, these brackets 51, 52 being fastened at the load carrier 12 and at a distance reaching around the sliver 15 moving in the plane 14. The brackets 51, 52 are made of plastic. When the drafting frame 1 is opened by the swivelling-away of the load carrier 12, the brackets 51, 52 enter into the area of the plane 14 and lift the sliver 15 in the direction toward the load carrier 12' off the bottom rollers 2, 3, 4, 5, 6 (FIG. 6). When the load carrier 12 is returned to its operative position (FIG. 5), the brackets 51, 52, also automatically, together with the load carrier 12, move into the operative position, in which they are located outside the moving path of the sliver 15.

Figure 7:
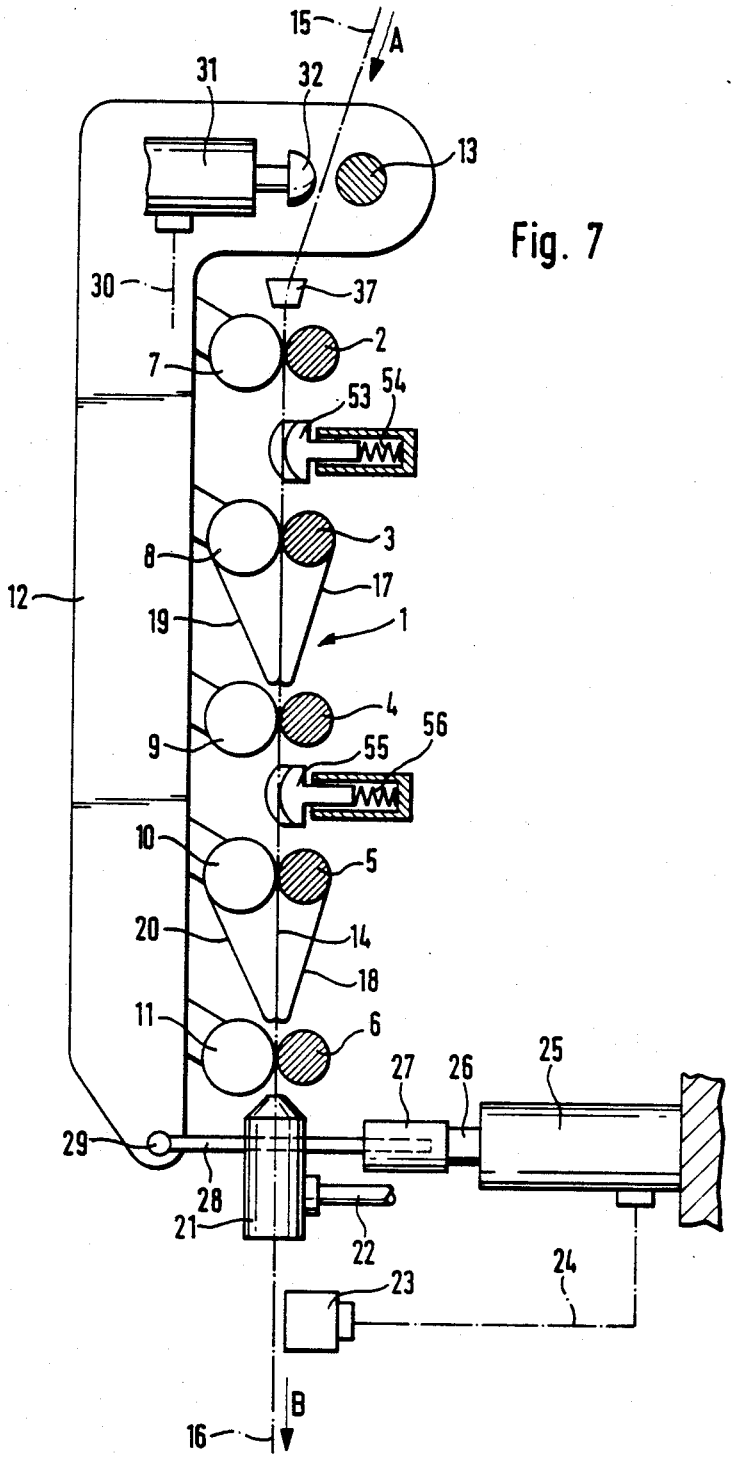
FIGS. 7 and 8 are schematic views of another preferred embodiment of the invention which utilize elastically held condensers for the sliver, shown respectively in the operative and in the inoperative position.
Figure 8:
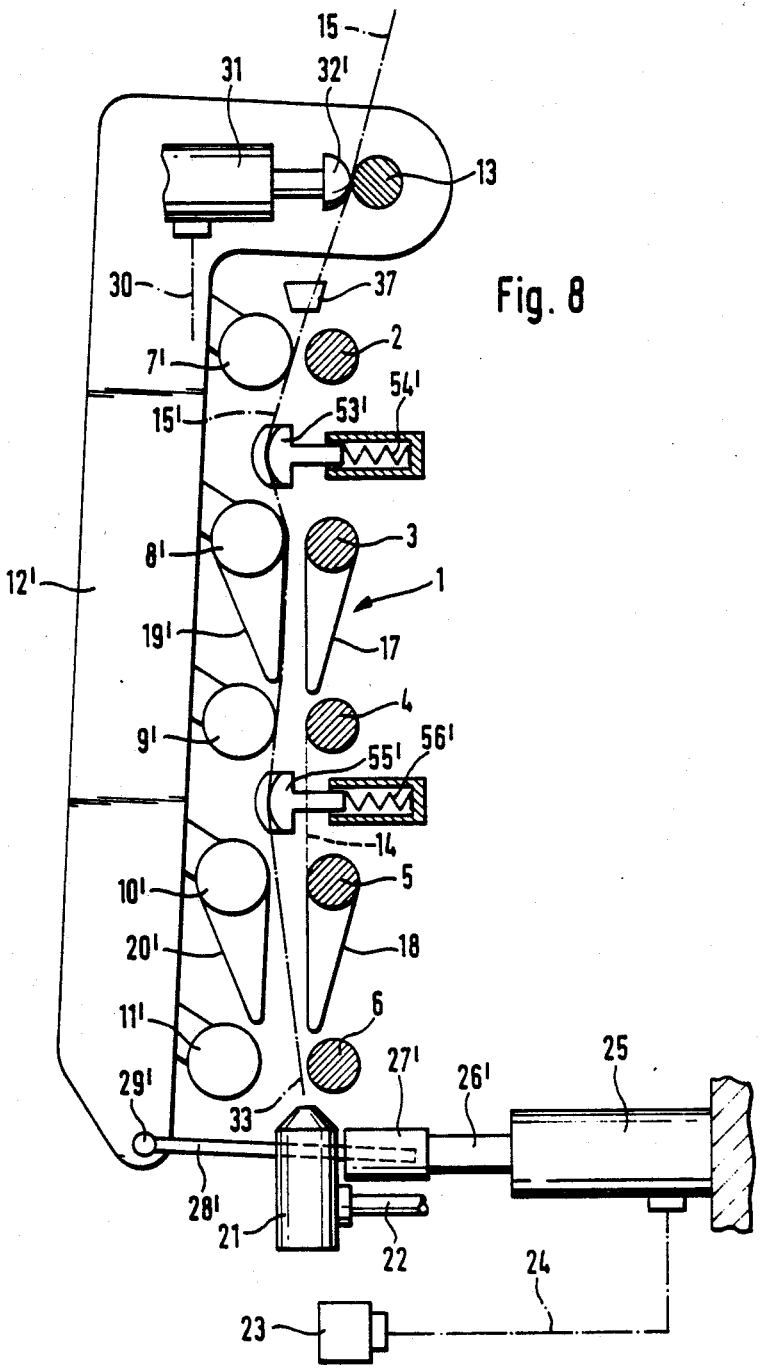

In the embodiment according to FIG. 7 and 8, guiding elements 53, 55 are provided that are similar to those provided in the embodiment according to FIGS. 3, 4, these guiding elements 53, 55 being arranged between the bottom rollers 2,3 and 4,5. The guiding elements 53, 55 are developed as condensers which are guided in guides and, by means of springs 54, 56, are loaded in the direction toward the sliver 15 and the load carrier 12. The load carrier 12, in a manner that is not shown in detail, may be equipped with stops reaching around the sliver 15, which hold the condensers 53, 55 in the shown operative position, in which they develop a condenser effect essentially only within the plane 14 of the drafting frame 1. It is also possible to dimension the springs 54, 56 such that the sliver 15, on the basis of its tension, holds the condensers 53, 55 in the operative position (FIG. 7), while only after the opening of the drafting frame 1 (FIG. 8), these condensers 53', 55' are moved out and lift the sliver 15 off the bottom rollers 2, 3, 4, 5, 6.

Figure 9:
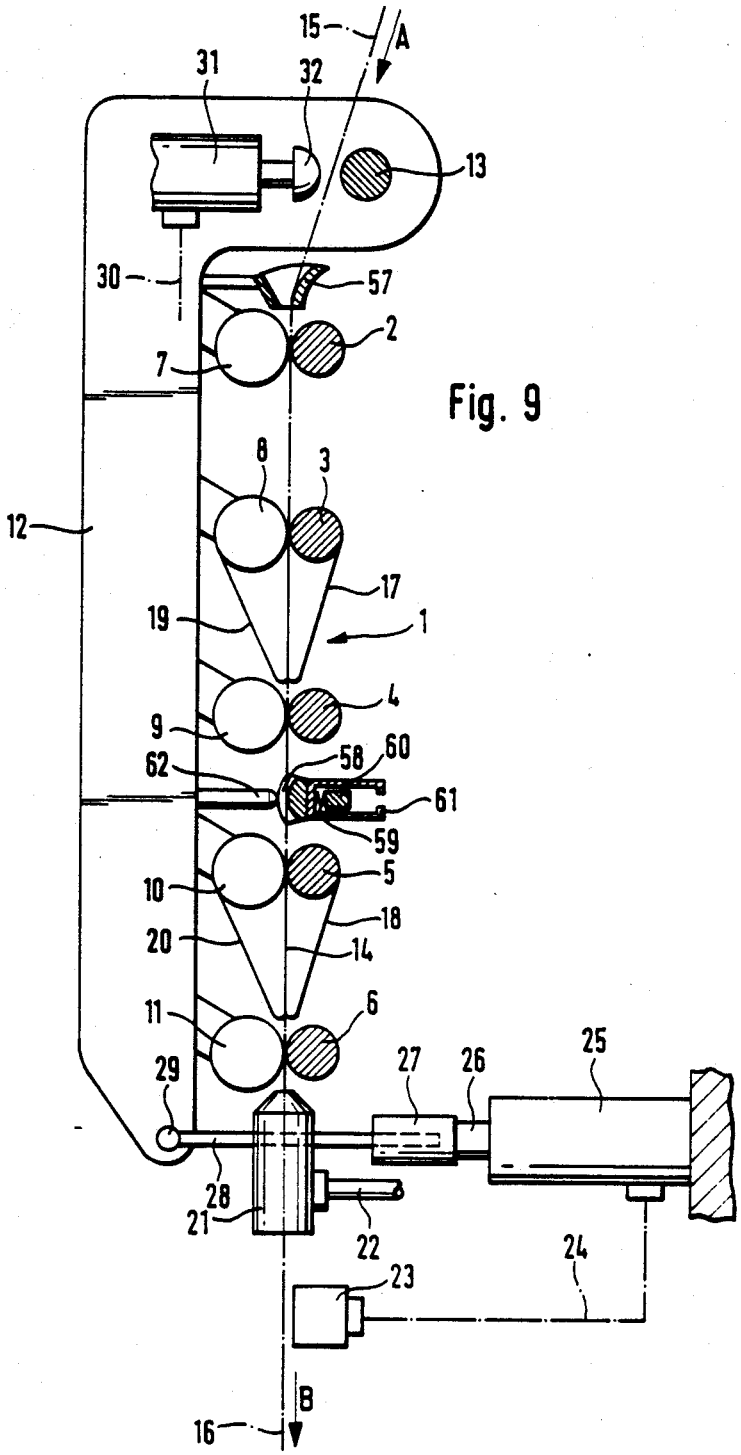
FIGS. 9 and 10 are schematic views of another with a spring-loaded condenser which is controlled via a stop of a load carrier, shown respectively in the operative and in the inoperative position.
Figure 10:
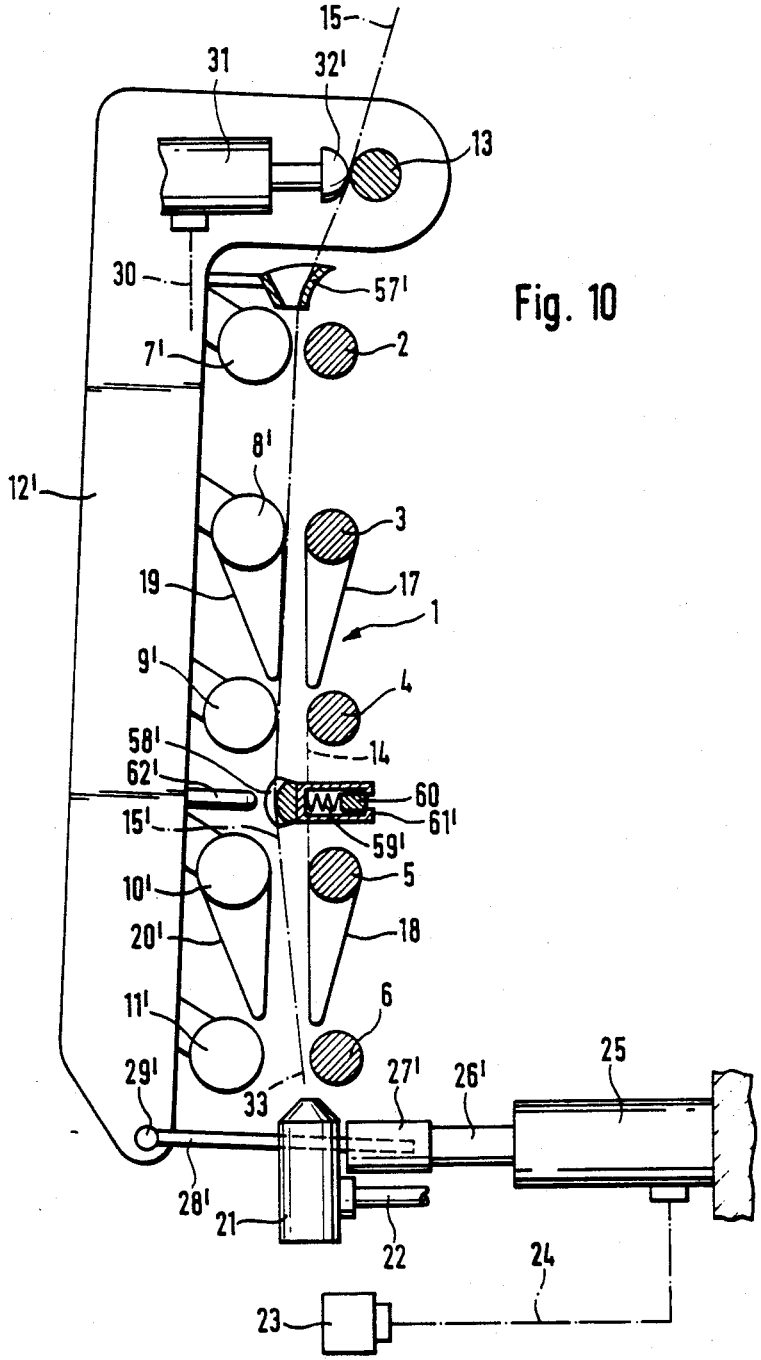

As shown by means of the embodiment according to FIGS. 9 and 10, which in principle corresponds to the embodiment according to FIG. 3 and 4 or 7 and 8, it is sufficient if, in the area between the bottom rollers 4, 5, a guiding device is arranged which, when the drafting frame 1 is opened, lifts the sliver 15' off the bottom rollers 2, 3, 4, 5, 6. In this embodiment, a condenser 58 is provided as the guiding device which, by means of a stop 62 of the load carrier 12, is held in the operative position (FIG. 9) against the effect of a pressure spring 59. The pressure spring 59 supports itself at a rail 60 passing through in longitudinal direction of the machine, a projection 61 of the condenser 58 reaching around this rail 60 and serving as a stop for limiting the lift-off position.

In the embodiment according to FIG. 9, 10, it is also provided that a feeding funnel 57 is connected in front of the pair of feeding rollers 2, 7, this feeding funnel 57 being held at the load carrier 12. This feeding funnel 57 therefore goes along in the swivelling motion of the load carrier 12' (FIG. 10) so that, as a result, the lifting of the sliver 15 off the bottom rollers 2, 3, 4, 5, 6 is supported. If necessary, it is possible to arrange the feeding funnel 57 such that it alone is sufficient for permitting the lift-off movement.

In connection with the embodiment according to FIG. 9 and 10, in which only one guiding element 58 is provided, a movable feeding funnel 57 is not required according to certain preferred embodiments, but is replaced by a stationary feeding element. As a rule, it will not be harmful particularly in the case of long-staple fiber material, if the sliver 15 is still in contact with the relatively slowly moving bottom roller 2 in the case of an interruPtion of the operation.

Figure 11:
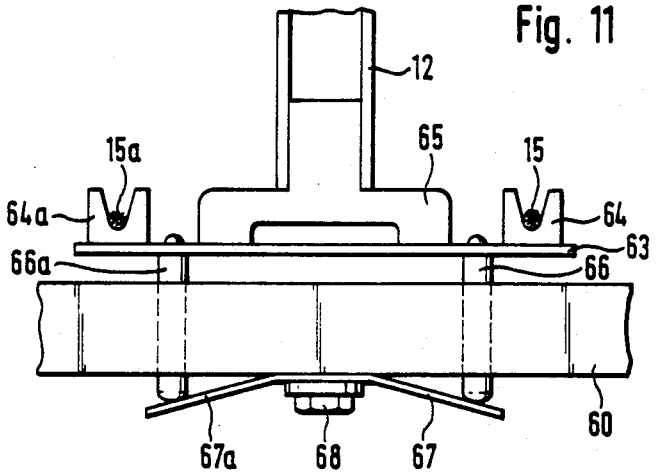
FIG. 11 is a view, in the travel direction of the sliver, of a drafting frame constructed according to preferred embodiments of the invention and having two elastically held lift-out elements which are secured in the operative position via the load carrier.

FIG. 11 shows a view in which two guiding elements 64, **64*a* for two adjacent slivers 15, 15*a* are held jointly and are jointly adjustable. The guiding elements 64, 64*a*, which are developed as condensers, are arranged on a plate 63 which is adjustably guided in a rail 60 by means of riveted-on pins 66, 66*a*. At the rail 60 a leaf spring is fastened by means of a screw 68, this leaf spring having two arms 67, 67*a* which are assigned to the pins 66, 66*a*. The load arm 12 is equipped with a stop 65 which places itself against the plate 63 and holds it in the operative position against the effect of the arms 67, 67*a* of the leaf spring. When the load arm 12 is swivelled away in upward direction, the stop 65 is taken along so that the condensers 64, 64*a* follow as a result of the spring force affecting the pins 66, 66*a* and take along the slivers 15, 15*a*. This movement, which is used as the lift-off movement from the bottom rollers, corresponding to the preceding embodiments, will be finished when the arms 67, 67*a* of the spring place themselves against the rail 60**.

Figure 12:
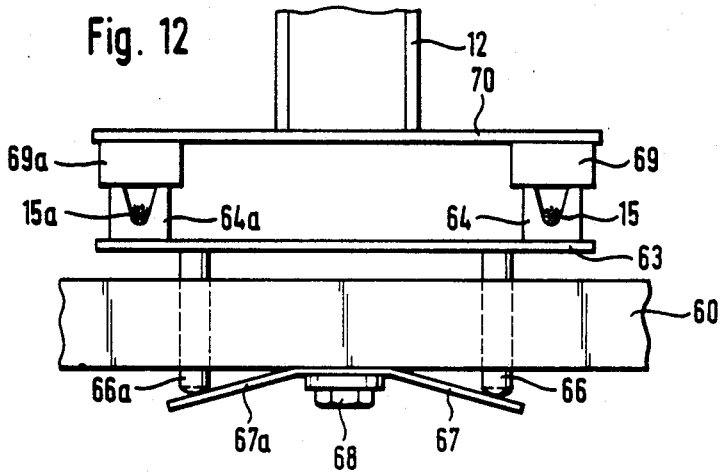
FIG. 12 is an arrangement, similar to FIG. 11, with modified devices, also mounted at the load carrier, for the holding of the condensers, shown in the operative position.

The embodiment according to FIG. 12 is modified with respect to the embodiment according to FIG. 11 in that the load arm 12, via blocks 69, **69*a* which are mounted at a plate 70 and consist preferably of an elastic material, supports itself directly at the condensers 64, 64*a*. As a result, the condensers 64, 64*a* having a V-shaped cross-section are closed so that the sliver 15, 15*a* is guided on all sides. In this case, it is expediently provided that, in the case of an interruption of the operation, the blocks 69, 69*a* are not completely lifted off the condensers 64, 64*a*** so that the guiding function is maintained even in the case of an interruption.

Figure 13:
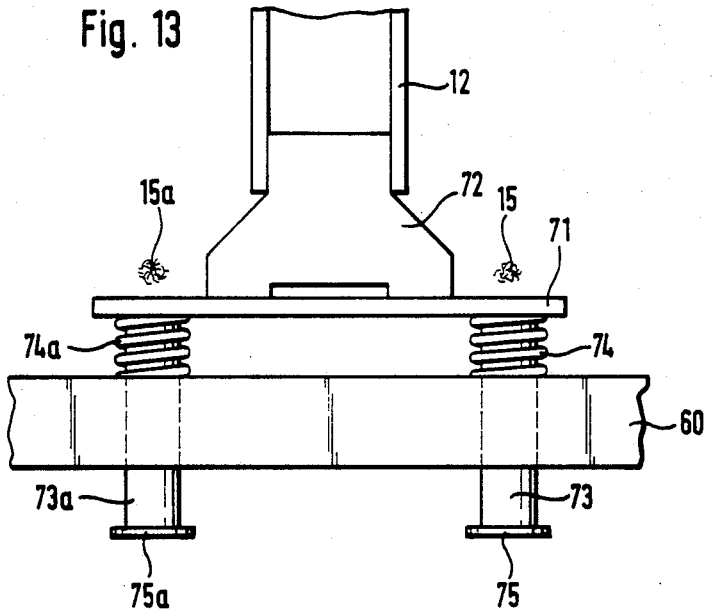
FIGS. 13 and 14 schematically depict another preferred embodiment of the invention with elastically held devices for the lifting-off of the sliver which are held in the operative position via stops of the load carrier.
Figure 14:
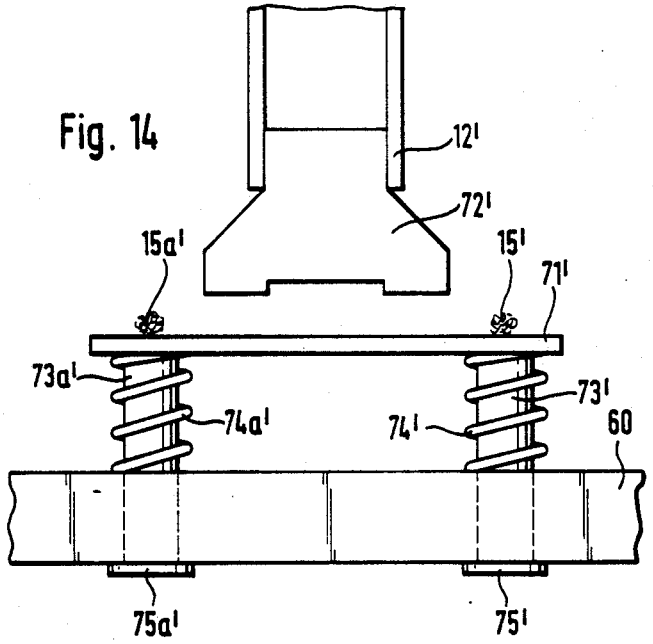

In the embodiment according to FIGS. 13 and 14, a table-type guiding element 71 is provided as a device for reducing the contact of two slivers 15, **15*a*, this guiding element extending over two adjacent drafting frames which are switched over simultaneously between the operative position and the inoperative position. In the operative position (FIG. 13), the guiding element 71, by means of a stop 72 of the load arm 12, is kept out of the moving path of the slivers 15, 15*a*. The guiding element 71 is guided in a guide rail 60, by means of two bolts 73, 73*a*, and is loaded in the direction toward the load carrier 12 by means of pressure springs 74, 74*a*. The bolts 73, 73*a* are equipped with end stops 75, 75*a* having a larger diameter. When the load carrier 12 is swivelled into its inoperative position, the stop 72 also lifts off and takes up position 72' (FIG. 14) The guiding element 71 will then follow into position 71' until the stops 75', 75*a'* rest against the rail 60. The slivers 15', 15*a'*** are then lifted off the bottom rollers which are not shown.

In the embodiments according to FIGS. 11 to 14, it is provided that the load carriers 12, in a manner that is not shown in detail, carry so-called pressure roller twins, i.e., in each case, two pressure rollers arranged on a joint shaft, these pressure rollers being arranged on one side of the load carrier 12 in each case. An opening of the drafting frame, therefore also in the case of this construction, takes place simultaneously for two adjacent slivers 15, **15*a***.

Figure 15:
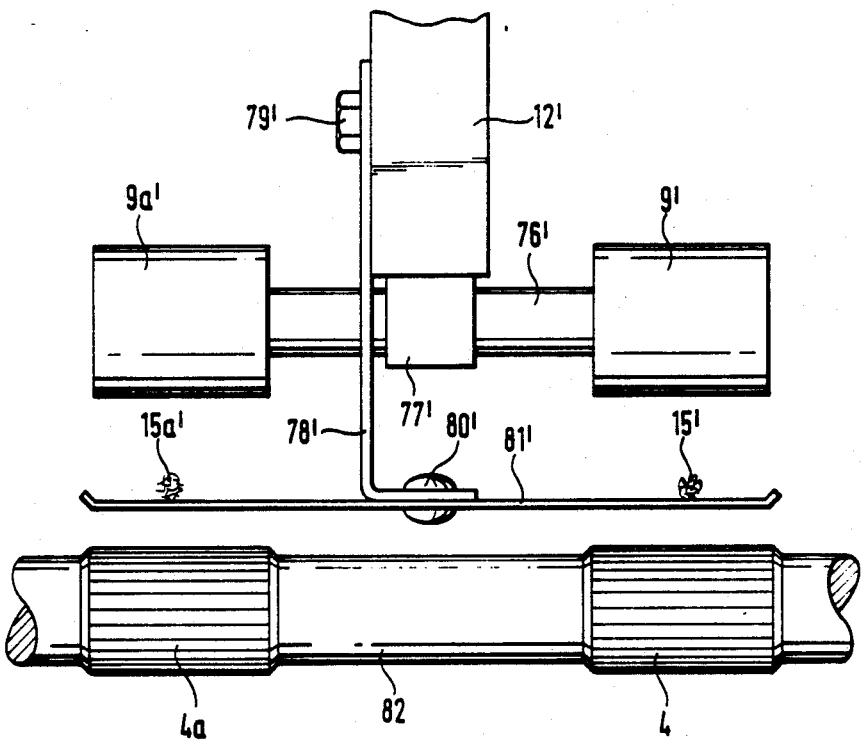
FIG. 15 is a view in the direction of the sliver of a preferred embodiment of the invention having devices for lifting the slivers off the bottom rollers, these devices being mounted at the load carrier of the pressure rollers.

In FIG. 15, the bottom rollers 4, **4*a* of two adjacent drafting frames are shown which are part of a shaft 82 extending through in the longitudinal direction of the machine and being composed of segments. Top rollers 9', 9*a'* are assigned to the two adjacent bottom rollers 4, 4*a*, these top rollers 9', 9*a'* being constructed as pressure roller twins and being disposed on a joint shaft 76' in a bearing element 77' of the load carrier 12'. FIG. 15 shows the two drafting frames in the position of an interruption of the operation. At the load carrier 12' a holding device 78' is fastened, via a screw 79', which holding device 78' has a bent end at which a table-type guiding element 81' is fastened, by means of a rivet 80'. The guiding element 81', in the normal position, is immersed between two successive bottom rollers 3, 4 such that is does not come in contact with the slivers 15', 15*a'*. In the shown inoperative position, it is, by means of the swivelling-away of the load carrier 12', lifted out from between the successive bottom rollers 3, 4 and has taken along the slivers 15', 15*a'* in such a manner that they are lifted off the bottom rollers 4, 4*a*** as well as off the invisible bottom rollers located in front and behind.

Figure 16:
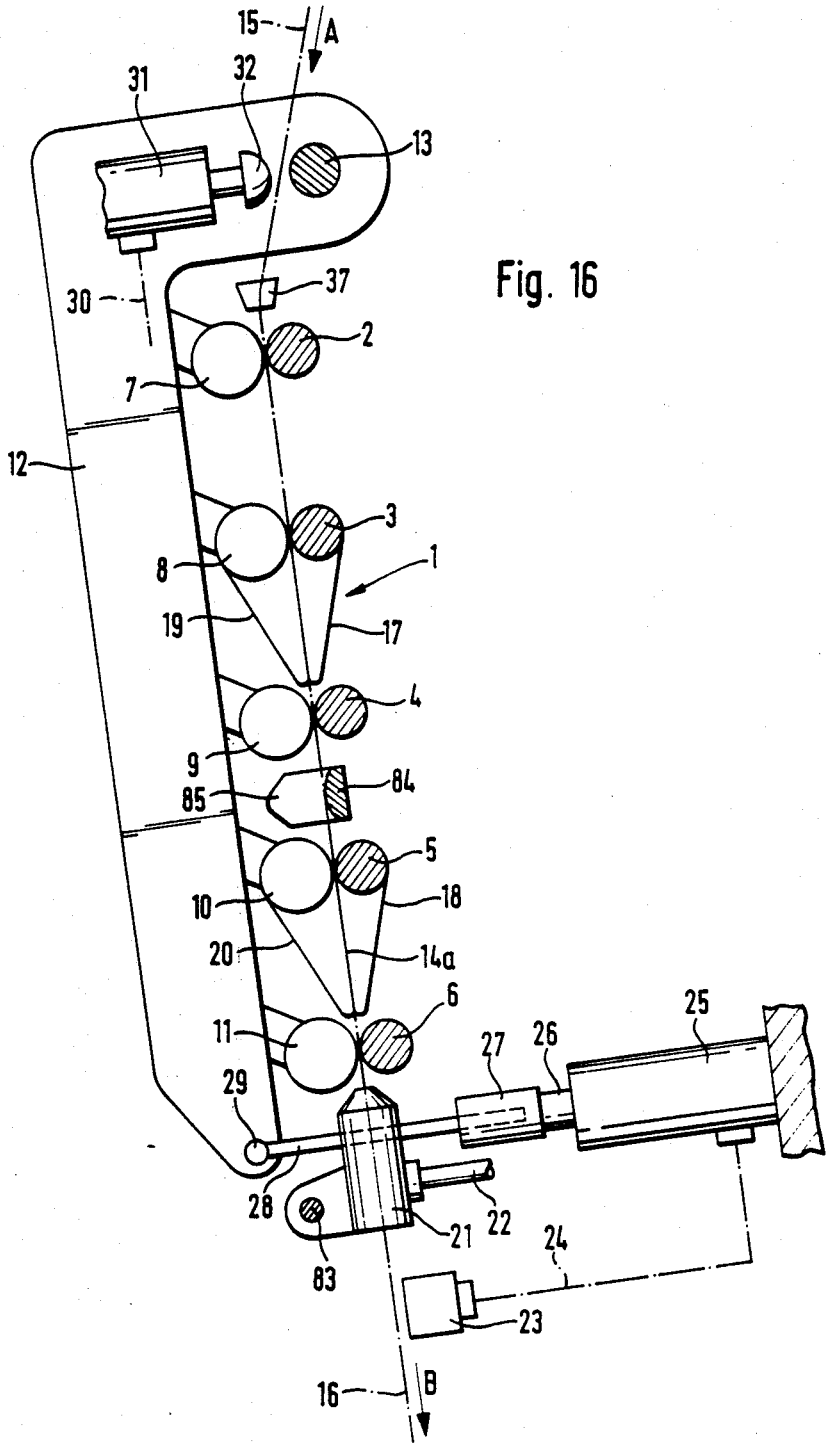
FIGS. 16 and 17 schematically depict another preferred embodiment of the invention in which the bottom rollers are arranged such that, when the pressure rollers are lifted off, the sliver detaches from the bottom rollers, shown respectively in the operative and in the inoperative positions.
Figure 17:
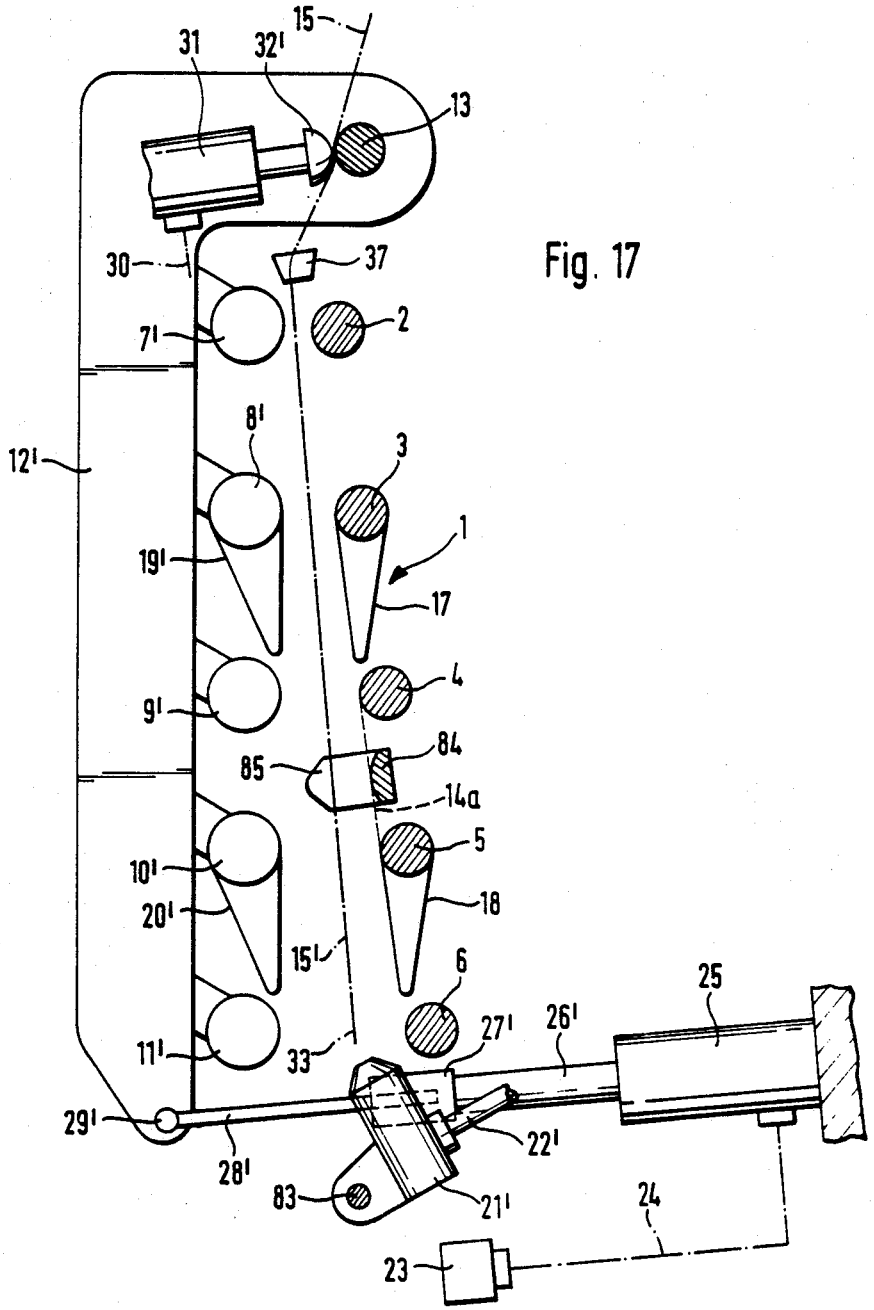

In the embodiment according to FIG. 16, 17, the high-draft drafting frame 1, with respect to space, is arranged such that, in the inoperative position (FIG. 17), the sliver 15, as a result of gravity, detaches itself from the bottom rollers 2, 3, 4, 5, 6. The high-draft drafting frame 1 is arranged such that the plane **14*a*, in moving direction (A) of the sliver 15, starting from a feeding funnel 37, forms an angle with the vertical line that opens up in moving direction (A), the pressure rollers 7, 8, 9, 10, 11 being located on the side facing the vertical line. When the drafting frame 1 is opened up as a result of a swivelling-away of the load carrier 12 into position 12' (FIG. 17), the sliver 15 approaches the vertical direction so that it detaches from the bottom rollers 2, 3, 4, 5, 6. In order give the lifted-off sliver 15' additional guidance, it is provided in the embodiment according to FIG. 16, 17 that the air nozzle 21 is pivoted around a shaft 83 and, when the high-draft drafting frame 1 is opened up, can be pivoted into position 21. (FIG. 17). In the process, the intake opening of the air nozzle 21' has moved away from the bottom roller 6. Also in this position, the air nozzle 21' is acted upon by compressed air, if necessary, with a reduced value, so that the end 33 of the sliver 15' is taken in and the sliver 15'** is kept drawn.

Between the bottom rollers 4, 5, a stationarily arranged condenser 84 is arranged. The lateral guides 85 of the condenser 84, which has a V-shaped cross-section and also narrows down in a V-shape in moving direction (A) of the sliver 15, lead relatively far up to the load carrier 12. They are held so long that, even in the opened position (FIG. 17), they still reach into the area of the joint tangent of the top rollers 7', 8', 9', 10', 11' so that the sliver 15' is securely guided also in this opened-up position of the high-draft drafting frame 1. As a result, the sliver 15' is guided securely during the interruption of the operation so that, during the subsequent restarting, it takes up a defined position. In a manner that is not shown, as a modification of the shown embodiment, additional lateral guiding elements are provided at the load carrier 12 and/or at the apron guiding elements in order to in addition hold the sliver 15' securely in the required position in the position of an interruption of the operation.

Figure 18:
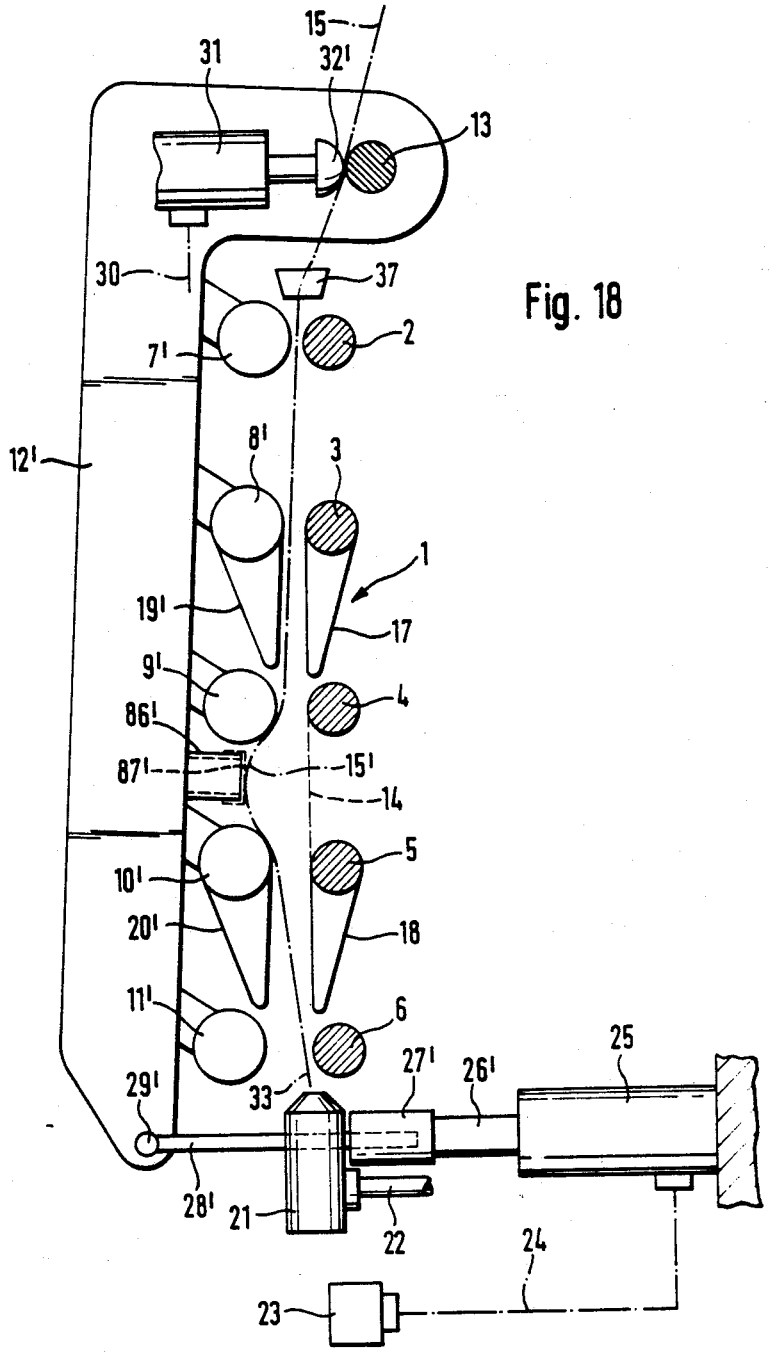
FIG. 18 is a schematic view of another preferred embodiment of the invention in which a load carrier is equipped with a suction device lifting the sliver off the bottom rollers, shown in the inoperative position.

In the embodiment according to FIG. 18 which shows a high-draft drafting frame 1 only in the position of the interruption of the operation, a suction nozzle 86' is arranged at the load carrier 12', the suction mouth of which is covered by a grid or screen 87'. This suction nozzle 86' may be acted upon permanently by a vacuum, i.e., during the normal operation, of a cleaning function. However, it is also contemplated to control this suction nozzle 86' by means of a valve that is not shown in such manner that it is connected with a vacuum source only in the swivelled-away position of the load carrier 12', in which case this valve can be controlled via the load carrier 12' or directly via the yarn monitor 23. The suction nozzle 86' takes the sliver 15' in and holds it in a position in which it is lifted off the bottom rollers 2, 3, 4, 5, 6. The screen 87' prevents that the sliver 15' is sucked into the suction nozzle 86'.

Figure 19:
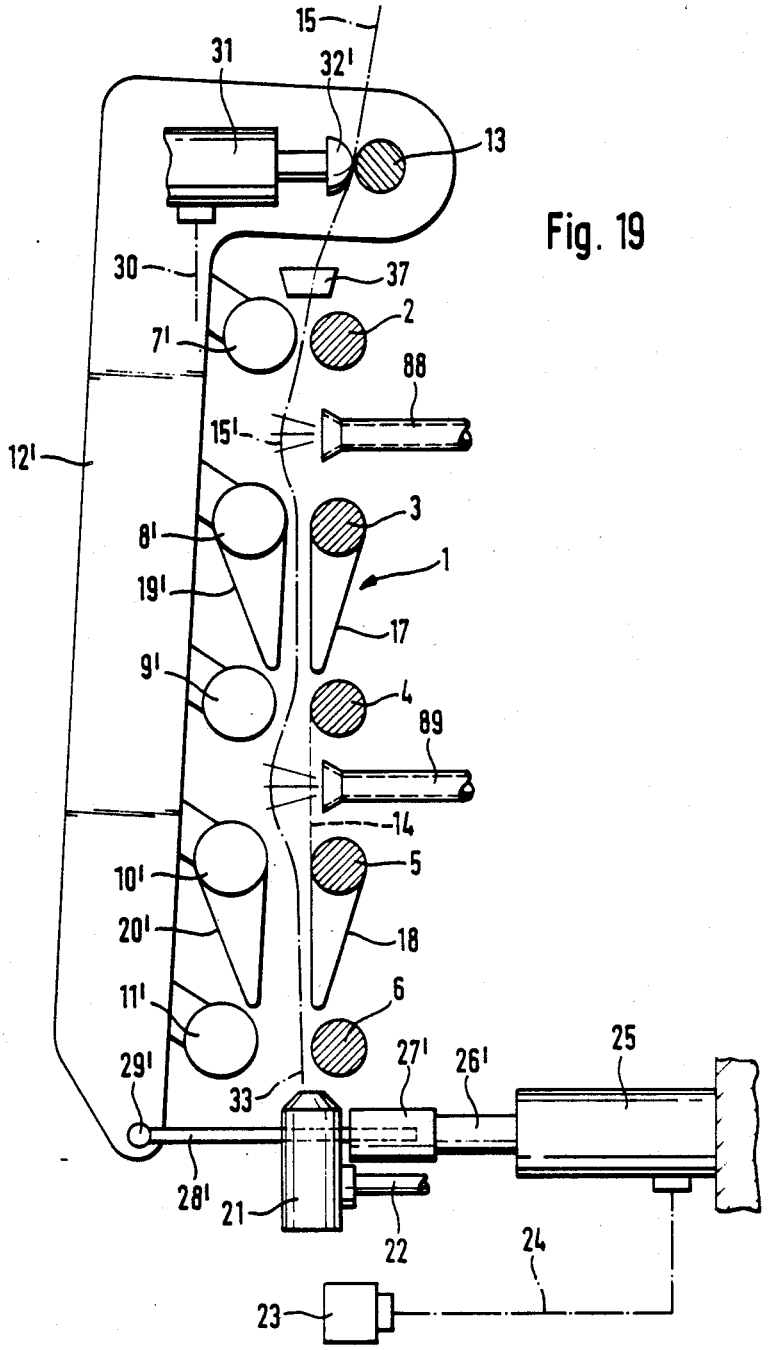
FIG. 19 is a schematic view of another preferred embodiment of the invention in which the sliver is lifted off the bottom rollers by means of blowing nozzles, shown in the inoperative position.

In the embodiment according to FIG. 19, which shows a high-draft drafting frame 1 also only during a servicing operation, blow nozzles 88, 89 are arranged between the bottom rollers 2, 3 and 4, 5, these blow nozzles 88, 89, in a manner that is not shown in detail, being connected to an excess pressure source, via a joint or in each case separate valve. The blow nozzles 88, 89 are aimed at the sliver 15 and blow it into the direction toward the swivelled-away load carrier 12'. The blow nozzles 88, 89 are actuated by means of the swivelling-away of the load carrier 12' which can be triggered either by the movement of the load carrier 12' or via the yarn monitor 23. By means of these blow nozzles 88, 89, the sliver 15', in the shown manner, is lifted off the bottom rollers 2, 3, 4, 5, 6.

As a modification of the shown embodiment, it is provided that suction nozzles assigned to the bottom rollers 2, 3, 4, 5 or 6, in the case of a servicing operation, i.e., when the high-draft drafting frame 1 is opened up it can be switched over, via a valve, such that they are then supplied with compressed air so that they will then blow out compressed air. The suction nozzles which, in the normal operation, are used for cleaning will then, in the servicing operation, be used as blow nozzles by means of which the sliver 15' is detached from the bottom rollers 2, 3, 4, 5, 6. In this case, it should be observed that the sliver 15' must not actually be lifted completely off the bottom rollers 2, 3, 4, 5, 6. As a rule, it is sufficient for the contact to be reduced to such an extent that the danger of a taking-along or of a pulling-out of individual fibers or fiber tufts is largely excluded.

Figure 20:
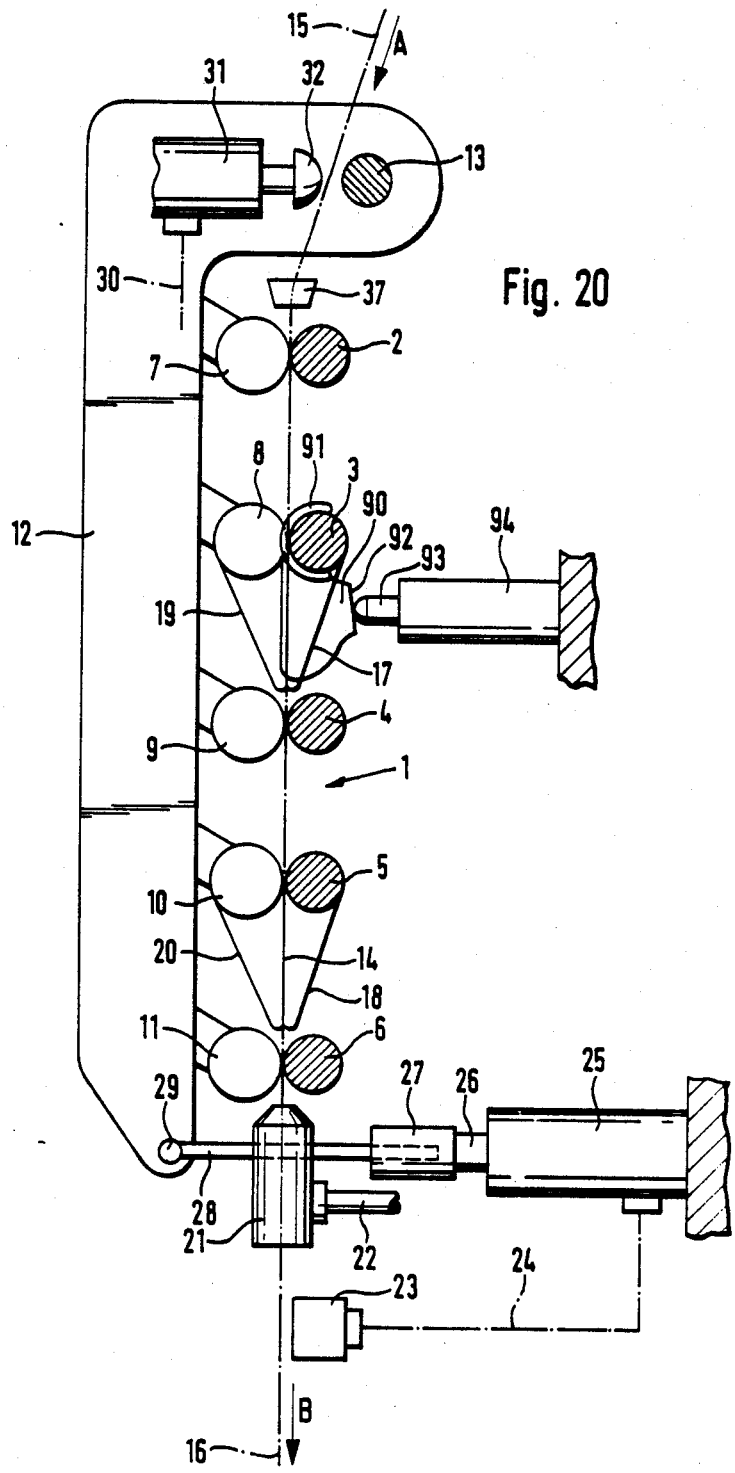
FIGS. 20 and 21 schematically depict another preferred embodiment of the invention, in which the bottom part of a double apron unit is used as the device for the lifting-off of the sliver, shown respectively in the operative and in the inoperative positions.
Figure 21:
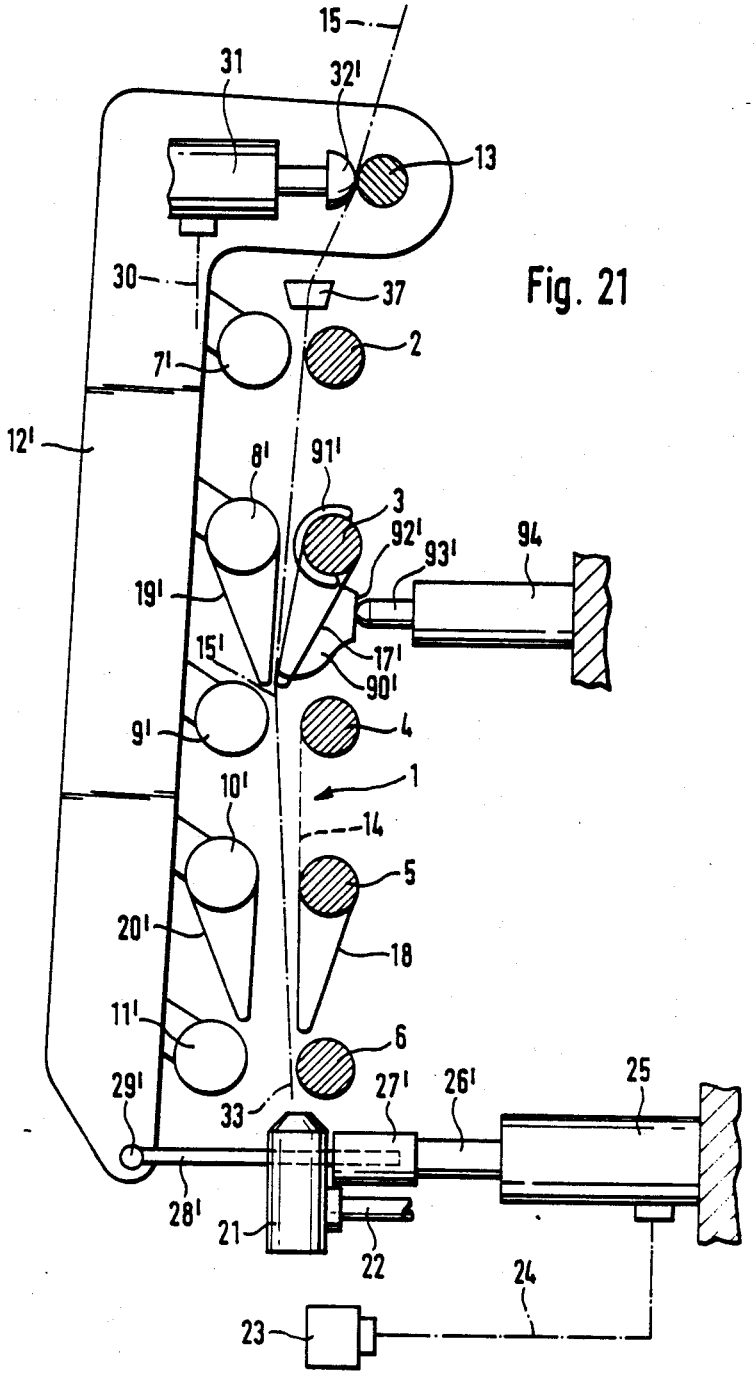

In the embodiment according to FIG. 20 and 21, it is provided that the reduction of the contact of the sliver 25', when the high-draft drafting frame 1 is opened up, takes place via the bottom part 90 of a double apron unit which is assigned to the pair 3, 8 of rollers following the pair 2, 7 of feeding rollers. In this case, the first double apron unit is preferred because, in this area, the sliver 15' is not yet drawn extensively and thus is still relatively thick, and because, in addition, the pair of rollers 3, 8 and thus also the lower apron 17' move relatively slowly in position 17'. The bottom part 90 of the double apron unit is disposed on the bottom roller 3, by means of a bearing shell 91 constructed as a cylinder segment. A tappet 93 of a control element 94 rests against a contact surface 92 facing away from the load carrier 12. In the simplest embodiment, the control element 94 may be a spring element which loads the bottom part 90 in the direction toward the load carrier 12 which, in turn, is equipped with a stop that is not shown by means of which the bottom part is held in the operative position (FIG. 20). In another embodiment, it is provided that the control element 94 works electromagnetically or pneumatically and can be triggered via the yarn monitor 23.

In another embodiment, it is provided that at the load carrier 12, a bow-shaped take-along element is mounted which holds the bottom part 90 of the double apron unit so that, with the swivelling-away of the load carrier 12 into the inoperative position 12', it is also swivelled into the inoperative position 90' (FIG. 21).

Figure 22:
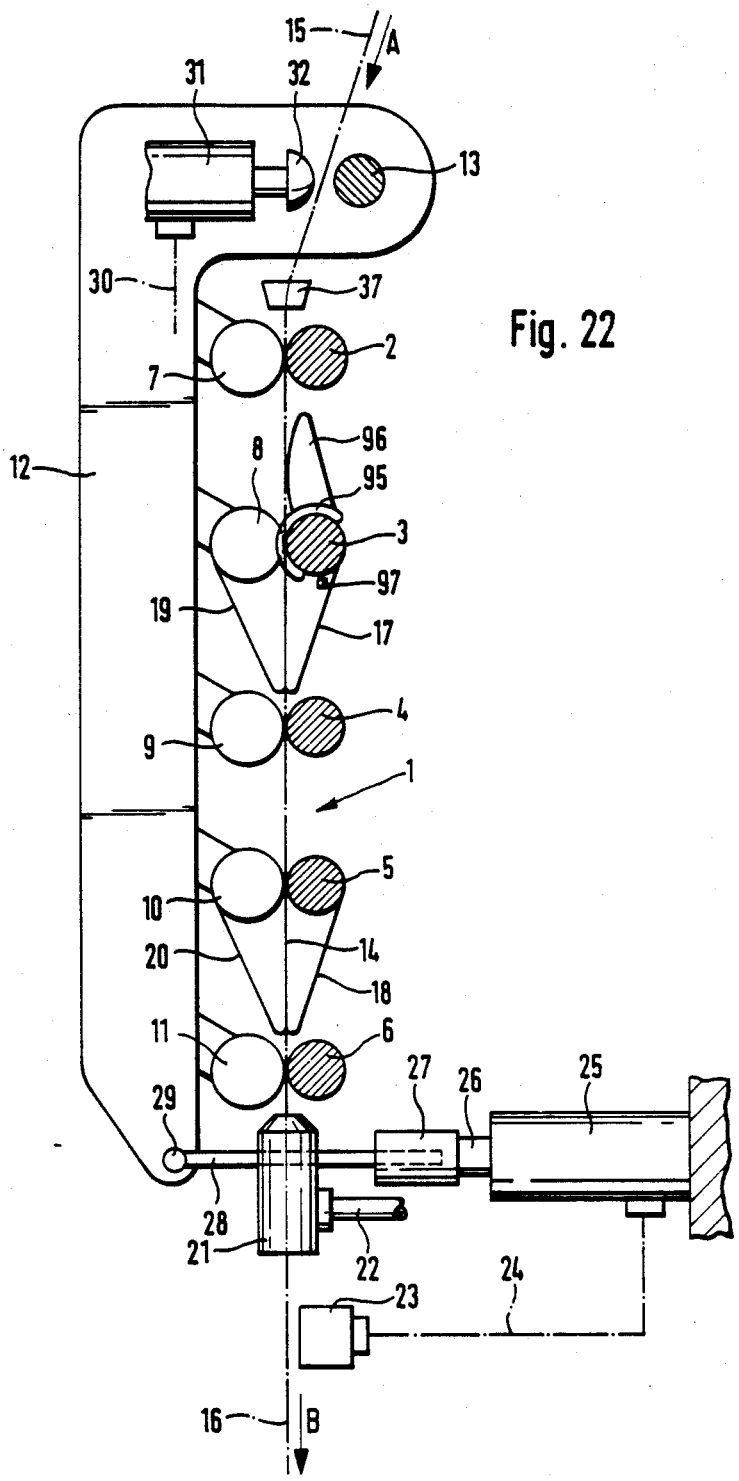
FIGS. 22 and 23 schematically depict another preferred embodiment of the invention with a clamping element assigned to a bottom roller which, in the case of a disturbance, is taken along by the bottom roller and lifts the sliver off the bottom rollers, shown respectively in the operative and in the inoperative position.
Figure 23:
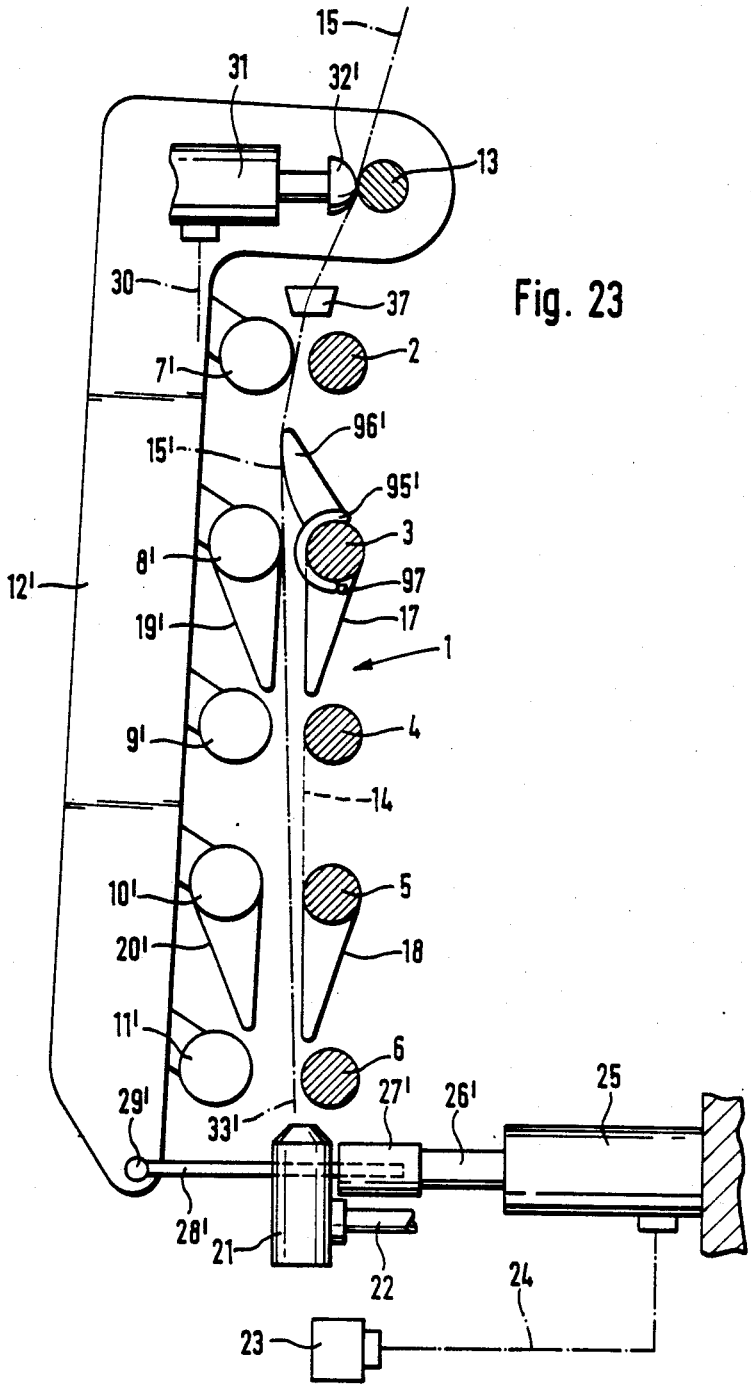

In the embodiment according to FIGS. 22 and 23, a guiding table 96 is arranged between the bottom rollers 2, 3, this guiding table 96 being disposed on the bottom roller 3 by means of a clamping segment 95. The clamping segment 95, with respect to its shape and its material, is constructed such that a defined friction and thus a defined take-along moment exists between it and the bottom roller 3. This take-along moment is less than the force which is exercised by the sliver 15 in opposite direction on the guiding table 96. If the load carrier 12, in the case of a yarn breakage or the like, is swivelled away (FIG. 23). the tension in the sliver 15' is reduced significantly. The moment between the bottom roller 3 and the clamping segment 95 will then be sufficient for taking it along in circumferential direction so that it takes up its position 95', in which it has moved against a stationary stop 97. The feeding table 96 and the clamping segment 95 constitute a relatively simple component made of a wear-resisting plastic material which may also be designed as an expendable part and can be exchanged if necessary.

Figure 24:
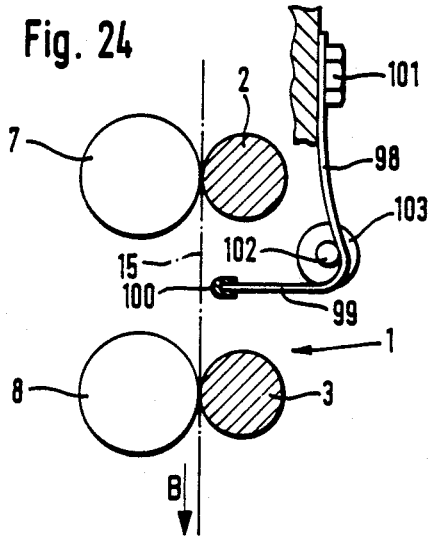
FIGS. 24 and 25 schematically depict another preferred embodiment of the invention for lifting a sliver off bottom rollers, shown respectively in the operative and in the inoperative positions.
Figure 25:
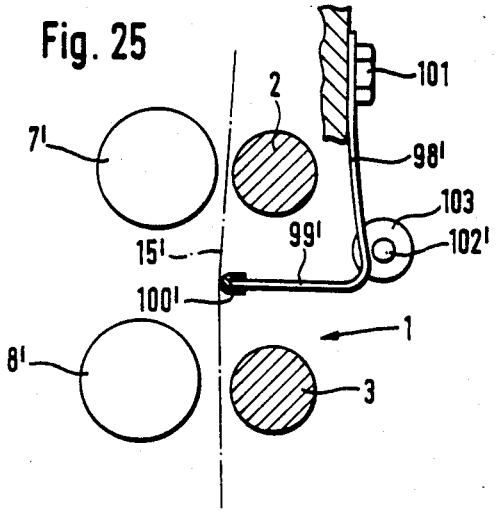

In the embodiment according to FIG. 24, 25, a stationarily arranged spring clip 98, 99 is provided, one leg 98 of which is stationarily held by means of a screw 101. The other leg 99, which extends approximately perpendicularly with respect to the sliver 15, is bent with respect to the first leg 98 by approximately 90°. The free end of the leg 99 is provided with a guard strip 100 made of plastic or the like. A control element 103, such as an operating magnet, is assigned to the spring clip 98, 99, this operating magnet with a tappet 102 resting against the leg 98 deflected against its spring power. When the tappet 102 is withdrawn, which is triggered directly or indirectly particularly by means of a yarn monitor that is not shown, the leg 98 returns to its essentially stretched form 98', in which case the leg 99 pushes itself into position 99' and as a result with the strip 100 lifts out the sliver 15 and transfers it to position 15'.

It is pointed out explicitly that the possibilities for reducing the contact or for the complete elimination of the contact of the sliver 15 with the bottom rollers 2, 3, 4, 5, 6, which are shown by means of the individual embodiments, may also be combined with one another. Thus it is possible, for example, to combine the embodiment according to FIG. 16, 17 with the embodiment according to FIG. 15, i.e., that the detaching of the sliver 15' as a result of gravity is supported by take-along devices 81' of the load carrier 12'. It is also possible to combine the Pneumatic devices 86'; 88, 89 of FIG. 18 or 19 with purely mechanical devices, or to also use them in connection with the embodiment according to FIG. 16, 17.

In the case of most of the shown and explained embodiments, it is expedient for the air nozzle 21 or another element, which follows the high-draft drafting frame 1 and into which the sliver 15 enters, to be moved away from the last bottom roller 6 together with the moving-away of the load carrier 12. If, in the process, the compressed-air supply to the air nozzle 21 is maintained completely or at least partially, this can also have the result that the sliver 15 can be moved out of the area of the bottom rollers 2, 3, 4, 5, 6 or the contact can at least be reduced. In this case, a contact with the feeding roller 2 is relatively harmless because the feeding roller 2 still moves at a relatively slow speed and because, at this point, the sliver 15 is still relatively thick. Under certain circumstances, it is sufficient to move the air nozzle 21 or another element receiving the sliver 15 out of the area of the bottom rollers 2, 3, 4, 5, 6 in the direction toward the lifted-off load carrier 12 in order to achieve a sufficient reduction of the contact of the sliver 15. As a modification, it is provided in this case that a clamp is assigned to the air nozzle 21 or another element receiving the sliver 15 by means of which the end 33 of the sliver 15 can be clamped in at the air nozzle 21 or the other element so that, although no air flow is maintained, the end 33 of the sliver 15 is also fixed in its position 15'.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A drafting frame arrangement for a spinning machine having a plurality of spinning units comprising:

driven bottom drafting roller means which extend over a plurality of spinning units, load carrier means at respective spinning units which carry top pressure roller means which cooperate with the bottom roller means to draft sliver passing therebetween when the load carrier means is in an operative drafting position, load carrier lifting means for lifting the load carrier means from the operative drafting position to a non-drafting position with the pressure roller means spaced from the bottom roller means, disturbance monitoring means for monitoring disturbances at individual spinning units and corresponding drafting units composed of a load carrier means and adjacent portions of the bottom roller means, and sliver control means for controlling the sliver at a respective drafting unit in response to detection of a disturbance by the disturbance monitoring means, said sliver control means including means for automatically moving the load carrier means to its non-drafting position and sliver contact reducing means for reducing sliver contact at the bottom roller means.

2. An arrangement according to claim 1, wherein said sliver contact reducing means includes sliver lifting means for lifting a sliver off the bottom roller means.

3. An arrangement according to claim 1, wherein the sliver contact reducing means are arranged in the normal moving path of the sliver and in the normal operation have a guiding function for the sliver.

4. An arrangement according to claim 3, wherein the sliver contact reducing means having a guiding function contains a feeding funnel.

5. An arrangement according to claim 1, wherein at least one of the sliver contact reducing means is constructed as a condenser.

6. An arrangement according to claim 1, wherein the sliver contact reducing means have a guiding function and are stationarily arranged offset outside the plane of the drafting frame in a direction toward the pressure rollers.

7. An arrangement according to claim 1, wherein the sliver contact reducing means are movably arranged on the bottom roller means and can be moved from a rest position into a deflected position.

8. An arrangement according to claim 7, wherein the sliver contact reducing means can be moved jointly with an associated load carrier means.

9. An arrangement according to claim 8, wherein the sliver contact reducing means are mounted at the load carriers means.

10. An arrangement according to claim 9, wherein a feeding funnel for the sliver is mounted at the load carrier means.

11. An arrangement according to claim 8, wherein the sliver contact reducing means are arranged elastically and are held in an inoperative position as long as the respective load carrier means is in an operative position, by means of stops of the load carrier means.

12. An arrangement according to claim 1, wherein the bottom roller means and a feeding guide are arranged in a plane which is sloped toward a vertical line in such a manner that, after the pressure roller means are moved away, the sliver detaches itself from the bottom roller means.

13. An arrangement according to claim 1, wherein an air nozzle is arranged behind the drafting frame into which the sliver enters.

14. An arrangement according to claim 13, wherein the air nozzle, which in the operative position is at least approximately arranged as an extension of the plane of the drafting frame, can be moved in the same direction as the pressure roller means away from the bottom roller means into an inoperative position.

15. An arrangement according to claim 1, wherein at least one pneumatic device is aimed at the travel path of the sliver, the direction of the effect of the at least one pneumatic device being aimed at the load carrier means.

16. An arrangement according to claim 1, wherein the sliver contact reducing means also exercise a guiding function and are composed of two parts and form a closed guiding lug, one of the parts being constructed so that it can be moved together with the load carrier means.

17. An arrangement according to claim 1, wherein on at least one bottom roller of the bottom roller means a guiding element is arranged which is equipped with a guiding table and which, after the load carrier means is moved away, can be moved into the moving path of the sliver by means of the bottom roller means which continues to run.

18. An arrangement according to claim 1, wherein the bottom part of at least one double apron unit including the bottom roller means moves in the direction toward the pressure roller means out of the plane of the drafting frame when the pressure roller means are lifted off.

19. An arrangement according to claim 1, wherein the sliver contact reducing means are each arranged in pairs and are assigned to two adjacent slivers.

* * * * *